US008545345B2

(12) United States Patent
Lo et al.

(10) Patent No.: US 8,545,345 B2
(45) Date of Patent: Oct. 1, 2013

(54) GOLF CLUB

(75) Inventors: Chih-Wei Lo, Taipei (TW); Jung-Ming Huang, Taipei (TW); Chien-Liang Li, Taipei (TW)

(73) Assignee: Fusheng Precision Co., Ltd., Taipei (TW)

( * ) Notice: Subject to any disclaimer, the term of this patent is extended or adjusted under 35 U.S.C. 154(b) by 0 days.

(21) Appl. No.: 13/220,765

(22) Filed: Aug. 30, 2011

(65) Prior Publication Data

US 2012/0088598 A1 Apr. 12, 2012

(30) Foreign Application Priority Data

Oct. 12, 2010 (CN) ..... 2010 2 0557520 U

(51) Int. Cl.
*A63B 53/02* (2006.01)

(52) U.S. Cl.
USPC ..... 473/307; 473/306

(58) Field of Classification Search
USPC ..... 473/307
See application file for complete search history.

(56) References Cited

U.S. PATENT DOCUMENTS

| | | | | |
|---|---|---|---|---|
| 7,922,599 | B2 | 4/2011 | Yamamoto | |
| 8,303,431 | B2 * | 11/2012 | Beach et al. | 473/307 |
| 2011/0207551 | A1 | 8/2011 | Breier et al. | |

FOREIGN PATENT DOCUMENTS

| | | |
|---|---|---|
| TW | M306127 U | 2/2007 |

* cited by examiner

*Primary Examiner* — Michael Dennis
(74) *Attorney, Agent, or Firm* — Alan Kamrath; Kamrath IP Lawfirm, P.A.

(57) ABSTRACT

A golf club includes a head, a removable assembly and a shaft. The head has a body, a striking panel and a sleeve. The body is coupled with the striking panel. The sleeve is sandwiched between the body and the striking panel. The sleeve includes a neck and an assembling portion. The neck protrudes from a combined structure of the body and the striking panel, and the assembling portion is sandwiched between and enclosed by the body and the striking panel. The neck has an assembling hole. The assembling portion has at least one engaging hole extending from a surface of the assembling portion to a circumferential wall of the assembling hole. At least one engaging medium is placed in the engaging hole. The removable assembly is disposed in the assembling hole and coupled with the engaging medium. The shaft has one end inserted into the removable assembly.

9 Claims, 7 Drawing Sheets

GOLF CLUB

BACKGROUND OF THE INVENTION

1. Field of the Invention

The present invention generally relates to a golf club and, more particularly, to a golf club with better surface integrity after a head and a shaft thereof are assembled.

2. Description of the Related Art

Referring to FIG. 1, Taiwan Patent No. M306127 discloses a connection structure of a golf club. The golf club has a head 81 whose angle can be adjusted as desired via the connection structure of the golf club. The golf club further comprises a removable assembly 82, a shaft 83 and a fixing member 84. The head 81 is coupled with one end of the shaft 83 via the removable assembly 82. The head 81 comprises a neck 811 having an adjusting hole 812 and a bolt hole 813. The adjusting hole 812 is arranged on one end of the neck 811. The bolt hole 813 is arranged on the surface of the neck 811. The removable assembly 82 has a positioning ring 821, a ring pad 822, an adjustment ring 823, a shank 824, a sleeve 825 and a fixing case 826. The shank 824 has a bolt hole 824*a*, and the sleeve 825 also has a bolt hole 825*a*.

During assembly of the golf club, the fixing member 84 is inserted into the bolt holes 813, 825*a* and 824*a* of the head 81, the sleeve 825 and the shank 824 to fix the head 81 and the shaft 83 together.

However, since the golf club requires drilling the head 81 to form the bolt hole 813, the surface integrity of the golf club will be poor. On the other hand, the bolt hole 813 can cause moisture in the air to enter the head 81 through a tiny gap between the bolt hole 813 and the fixing member 84. As a result, the fixing member 84 as well as the shank 824 and the sleeve 825 in the neck 811 can become rusty and oxidized. This may lead to component loosening and may shorten the service life of the golf club. Moreover, because the golf club is assembled by many components, component costs are higher, and a complex assembly procedure results.

Referring to FIG. 2, Japanese Patent Publication No. 2008-284289 discloses another golf club. The golf club has a head 91, a sleeve 92, a fixing case 93, a shaft 94 and a fixing member 95. The head 91 includes a neck 911 having an assembling hole 912, a plurality of notches 913 and a bolt hole 914. The bolt hole 914 is arranged on the surface of the neck 911. The sleeve 92 has an insertion hole 921, a plurality of protrusions 922 and a bolt hole 923. The insertion hole 921 is arranged on one end of the sleeve 92. The protrusions 922 are arranged on the surface of the sleeve 92 at one end of the sleeve 92. The bolt hole 923 is arranged on the surface of the sleeve 92 at the other end of the sleeve 92.

When the golf club is assembled, the shaft 94 is inserted through the fixing case 93 and inserted into the insertion hole 921 of the sleeve 92. Then, the sleeve 92 is inserted into the assembling hole 912 of the neck 911 until the protrusions 922 are engaged in the notches 913 and the bolt hole 923 of the sleeve 92 is aligned with the bolt hole 914 of the head 91. Finally, the fixing member 95 is used to screw the head 91 and the shaft 94 together, thus the completing assembly procedure of the golf club.

Although the golf club in FIG. 2 is relatively simplified compared to the golf club in FIG. 1, the fixing member 95 still remains on the surface of the head 91. This also affects the surface integrity of the golf club and causes moisture in the air to enter the head 91. As a result, the components inside the head 91 may still become oxidized or loosened, shortening the service life of the golf club.

SUMMARY OF THE INVENTION

It is therefore the primary objective of this invention to provide a golf club with better surface integrity.

It is another objective of this invention to provide a golf club that prevents moisture in the air from entering a head thereof, thereby keeping the components inside the head from becoming oxidized or rusted.

The invention discloses a golf club comprising a head, a removable assembly and a shaft. The head has a body, a striking panel and a sleeve. The body is coupled with the striking panel. The sleeve is sandwiched between the body and the striking panel. The sleeve comprises a neck and an assembling portion. The neck protrudes from a combined structure of the body and the striking panel, and the assembling portion is sandwiched between and enclosed by the body and the striking panel. The neck has an assembling hole extending from one end of the neck to the assembling portion. The assembling portion has at least one engaging hole extending from a surface of the assembling portion to a circumferential wall of the assembling hole. At least one engaging medium is placed in the at least one engaging hole. The removable assembly is disposed in the assembling hole and coupled with the at least one engaging medium. The shaft has one end inserted into the removable assembly.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
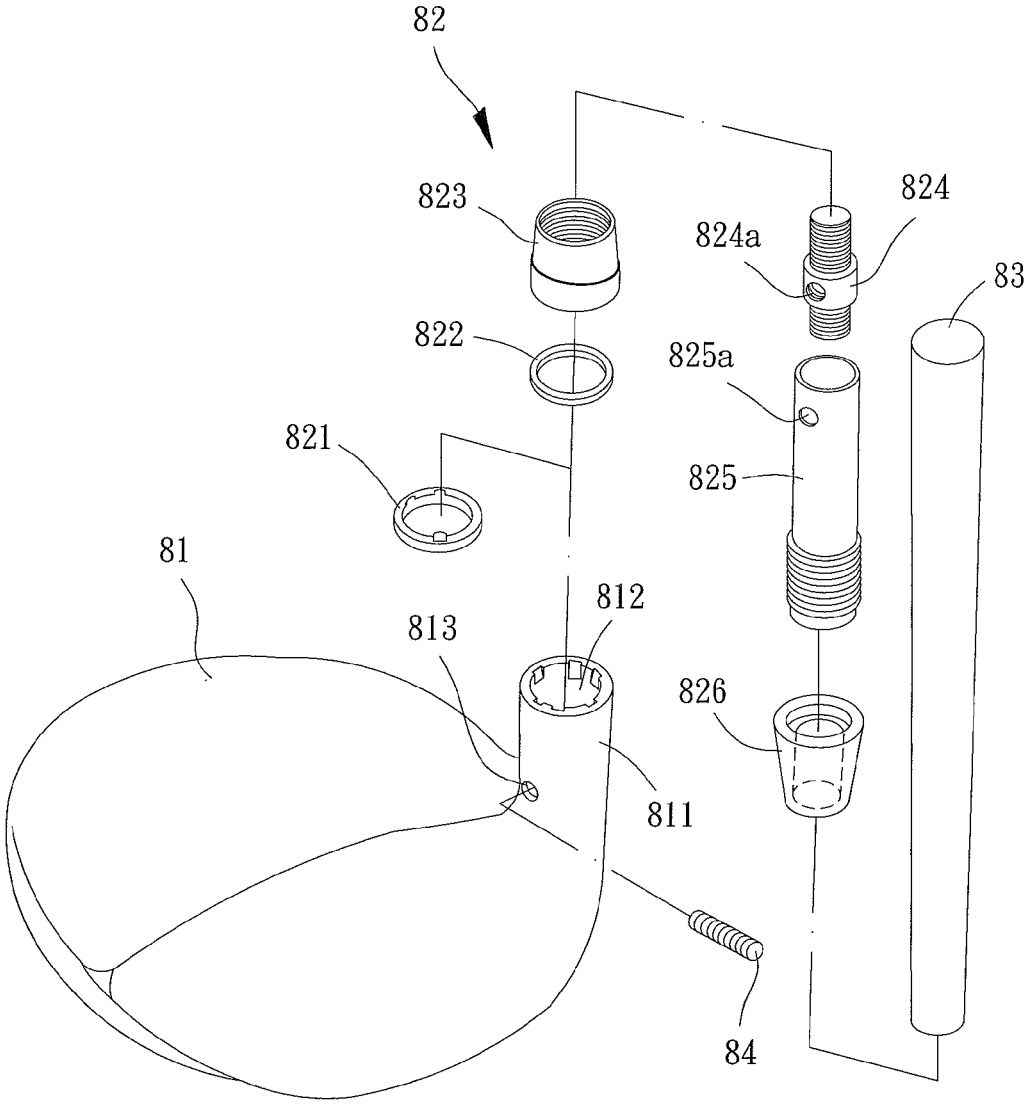
FIG. 1 PRIOR ART
FIG. 1 is an exploded view of a conventional golf club.
Figure 2:
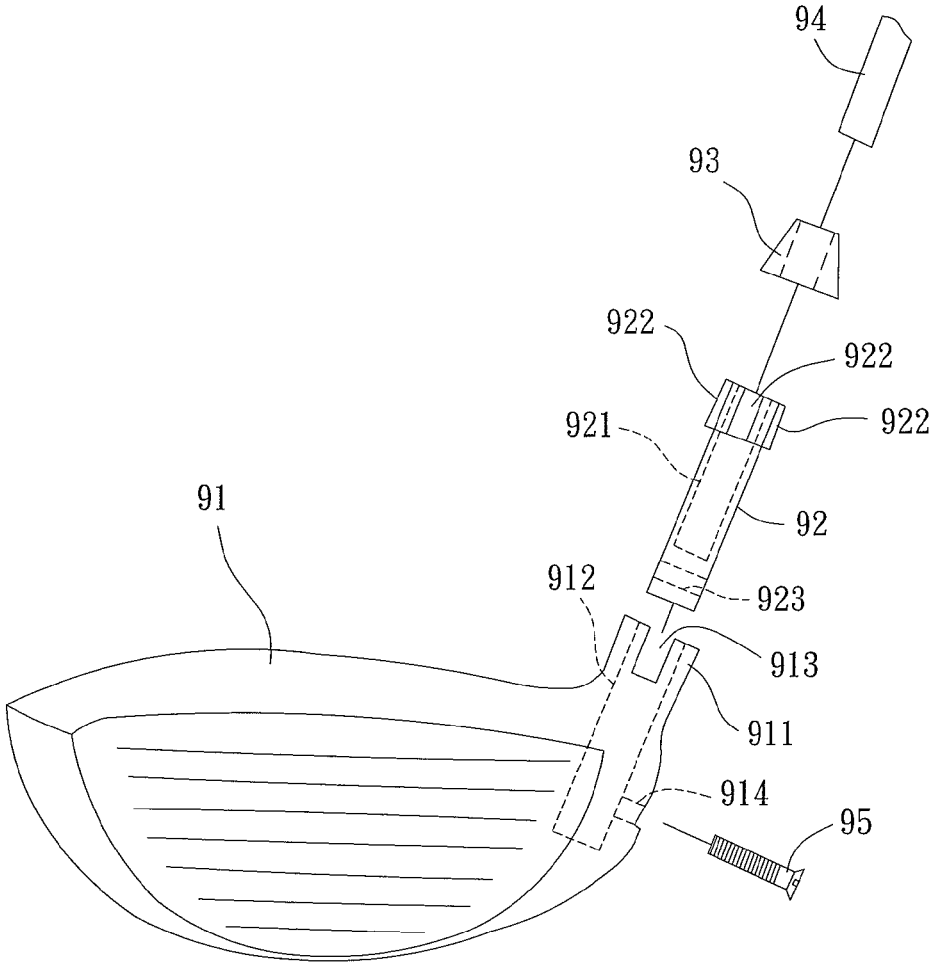
FIG. 2 PRIOR ART
FIG. 2 is an exploded and cross sectional view of another conventional golf club.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
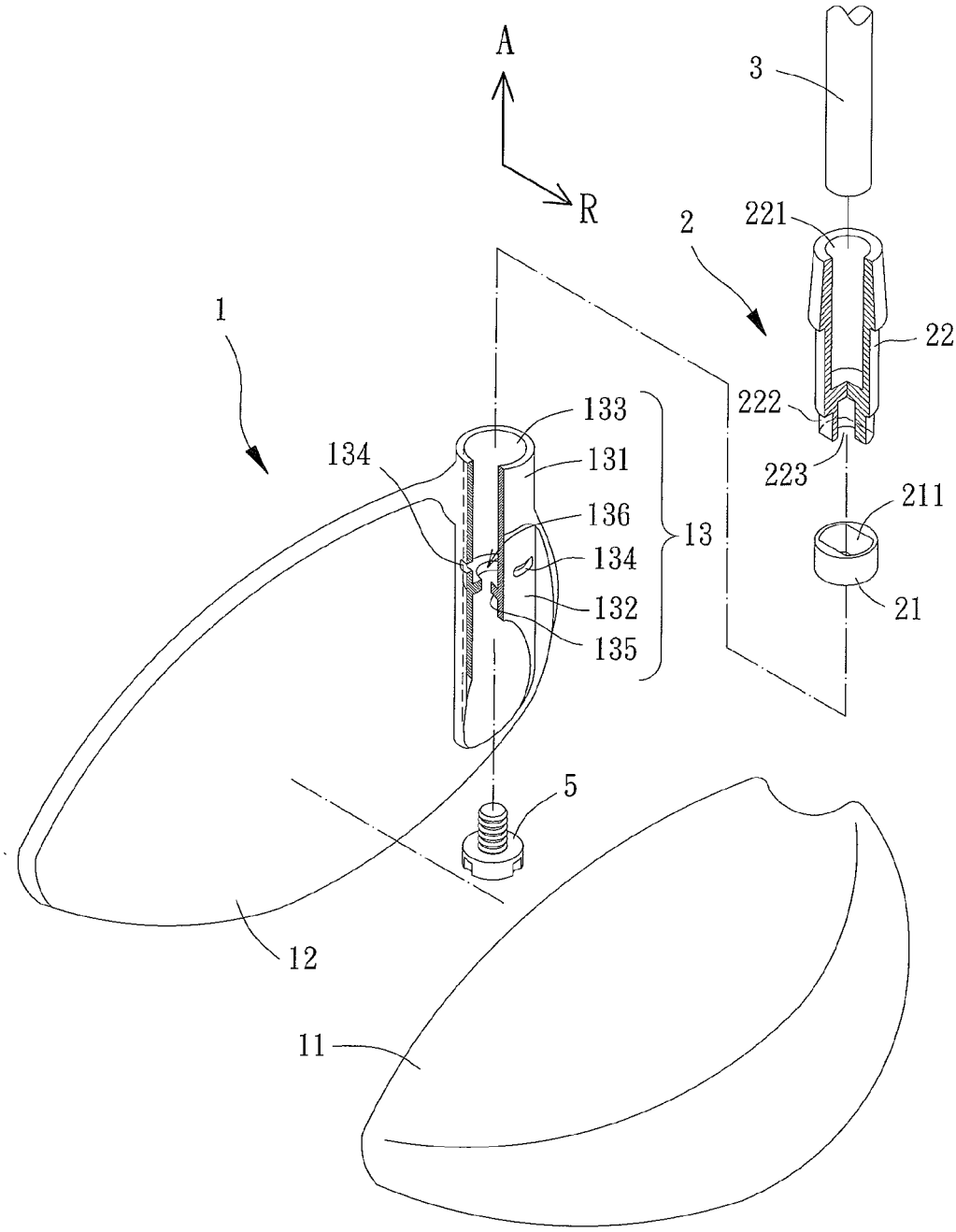
FIG. 3 is an exploded view of a golf club according to a first embodiment of the invention.
Figure 4:
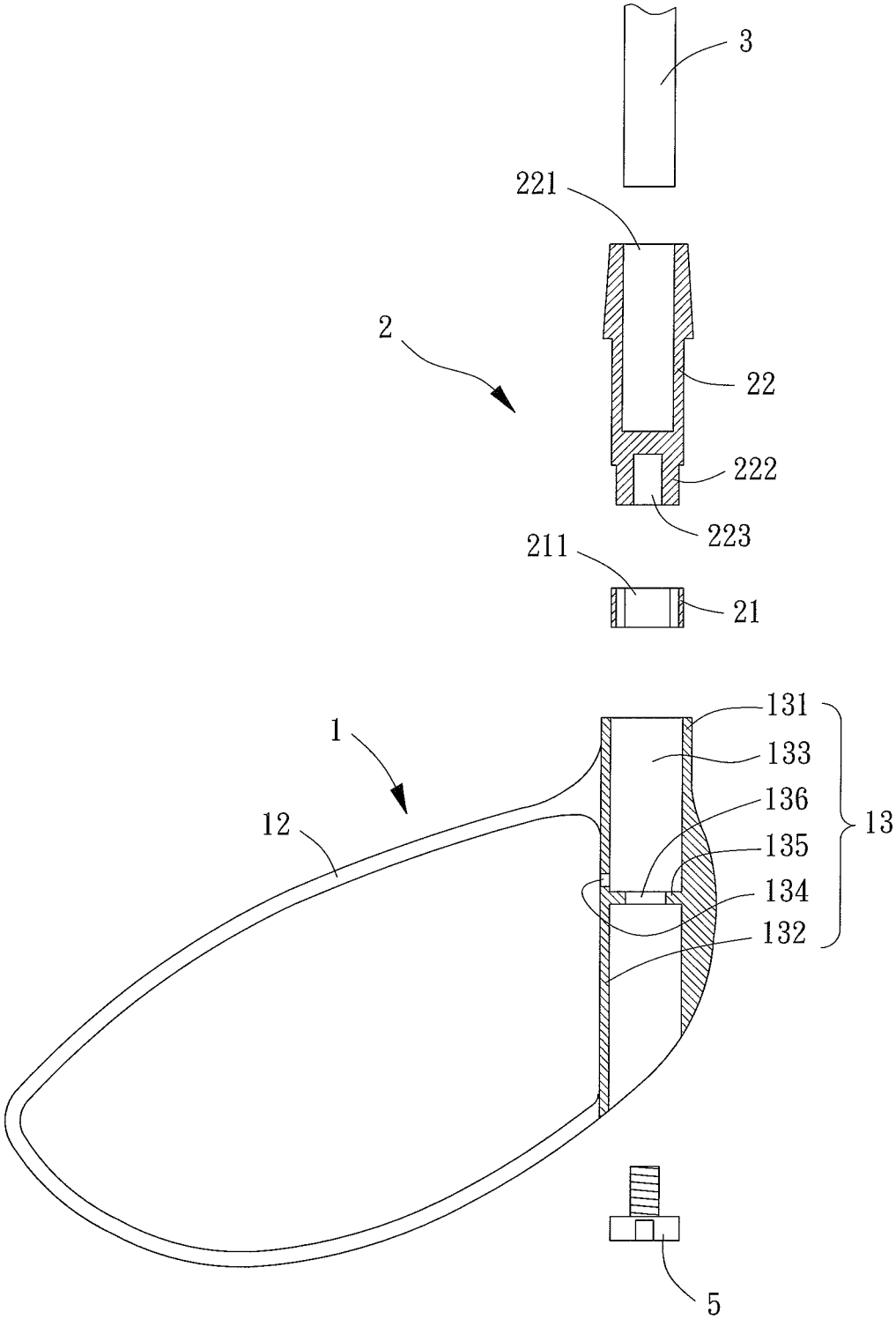
FIG. 4 is an exploded and cross sectional view of the golf club of the first embodiment of the invention.

Referring to FIGS. 3 and 4, a golf club comprising a head 1, a removable assembly 2 and a shaft 3 is disclosed according to a first embodiment of the invention. The head 1 is coupled with one end of the shaft 3 via the removable assembly 2. A user can hold the shaft 3 with hands and hit a ball with the head 1.

The head 1 comprises a body 11, a striking panel 12 and a sleeve 13. The body 11 is coupled with the striking panel 12. The sleeve 13 can be sandwiched between the body 11 and the striking panel 12. Alternatively, the sleeve 13 can also be integrally formed on the body 11 or the striking panel 12. In this embodiment, the sleeve 13 is integrally formed on the striking panel 12. The sleeve 13 comprises a neck 131 and an assembling portion 132. The neck 131 protrudes from the body 11 and the striking panel 12. The assembling portion 132 is arranged between and enclosed by the body 11 and the striking panel 12. The neck 131 has an assembling hole 133 extending from one end of the neck 131 to the assembling portion 132 in an axial direction A. The assembling portion 132 has at least one engaging hole 134 extending from the surface of the assembling portion 132 to a circumferential wall of the assembling hole 133. The at least one engaging hole 134 may extend in a radial direction R perpendicular to the axial direction A.

A blocking portion 135 is arranged on the circumferential wall of the assembling hole 133. The blocking portion 135 may be in the form of a circular plate or a ring. In this embodiment, the blocking portion 135 is implemented as a ring with a through-hole 136 at a center thereof.

Figure 5:
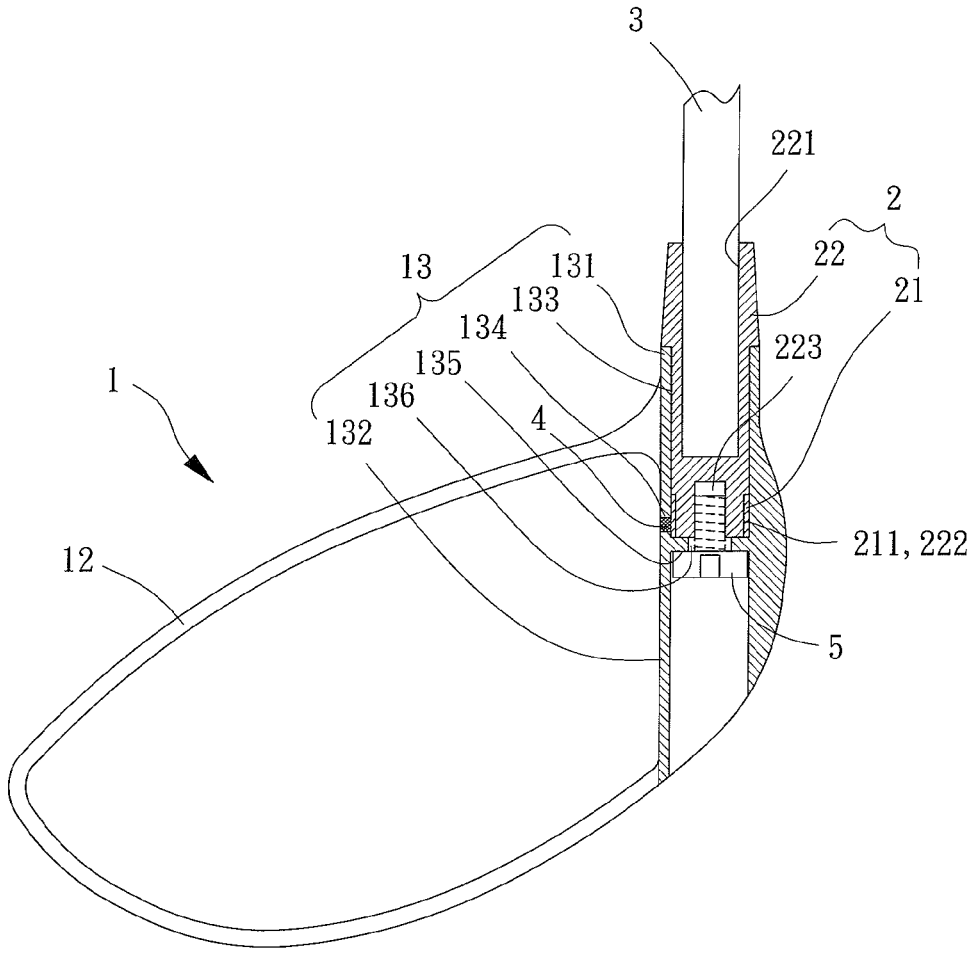
FIG. 5 is a cross sectional view of the golf club of the first embodiment after assembly.

Referring to FIGS. 3, 4 and 5, the removable assembly 2 is connected between the neck 131 of the head 1 and the shaft 3. In this embodiment, the removable assembly 2 consists of a retaining ring 21 and a case 22, but is not limited thereto. The retaining ring 21 has an insetted hole 211 whose radial cross section may be in a noncircular form. The retaining ring 21 is placed on the blocking portion 135 in the assembling hole 133 when the at least one engaging hole 134 faces an outer circumferential face of the retaining ring 21. In such an arrangement, at least one engaging medium 4 may be provided and placed in the at least one engaging hole 134 in a way that the at least one engaging medium 4 abuts against the outer circumferential face of the retaining ring 21. As such, the retaining ring 21 can be prevented from rotating in the assembling hole 133.

The engaging medium 4 may be any component or material capable of coupling the sleeve 13 and the retaining ring 21 together, such as a welding material, an adhesive, a bolt or a screw. In this embodiment, the engaging medium 4 is implemented as the welding material or the adhesive. When the welding material or the adhesive is filled into the at least one engaging hole 134 and becomes solidified, the welding material or the adhesive will attach to the outer circumferential face of the retaining ring 21. The solidified welding material or adhesive will restrict the retaining ring 21 from rotating in the assembling hole 133, thereby securely fixing the retaining ring 21 in the assembling hole 133. In another case, the engaging medium 4 can also be implemented as the bolt. In this regard, one or more bolt holes corresponding to the bolt(s) will have to be arranged on the outer circumferential face of the retaining ring 21, such that the bolt(s) can be inserted into the bolt hole(s) of the retaining ring 21 to fix the retaining ring 21 in the assembling hole 133. In still another case, the engaging medium 4 can also be implemented as a screw. In this regard, one or more screw holes corresponding to the screw(s) will have to be arranged on the outer circumferential face of the retaining ring 21, such that the screw(s) can be screwed into the screw hole(s) of the retaining ring 21 to fix the retaining ring 21 in the assembling hole 133.

The case 22 has an insertion hole 221 and an insetting portion 222 on two ends thereof. The radial cross section of the insetting portion 222 is in the same shape as the insetted hole 211. The case 22 is received in the assembling hole 133 and the insetting portion 222 is inserted into the insetted hole 211. In this way, the case 22 can be prevented from rotating relatively to the sleeve 13 via the engagement between the insetting portion 222 and the insetted hole 211.

An adhesive can be applied to the surface of the case 22 and the circumferential wall of the assembling hole 133 in order to securely fix the case 22 in the assembling hole 133. Alternatively, a screw hole 223 may be arranged on the end of the case 22 where the insetting portion 222 is, so that a fixing member 5 can be provided and screwed into the screw hole 223 via the through-hole 136 to provide an enhanced coupling effect between the case 22 and the sleeve 13.

One end of the shaft 3 is inserted into the insetted hole 211, and the adhesive can also be applied to the surface of the shaft 3 and a wall of the insertion hole 221 to securely fix the shaft 3 in the insetted hole 211.

Since the assembling portion 132 of the sleeve 13 is sandwiched between and enclosed by the body 11 and the striking panel 12, the at least one engaging hole 134 adapted to couple the sleeve 13 and the removable assembly 2 together will also be sandwiched and enclosed by the body 11 and the striking panel 12. Therefore, there won't be any engaging hole or fixing member remaining on the surface of the head 1, providing a better surface integrity for the golf club. Furthermore, since the head 1 of the golf club as proposed does not have any hole or gap on the surface thereof, moisture in the air can be prevented from entering the head 1. Thus, rustiness or oxidization of the components inside the head 1 can be avoided. Therefore, the proposed golf club will have a better performance and a longer service life.

Figure 6:
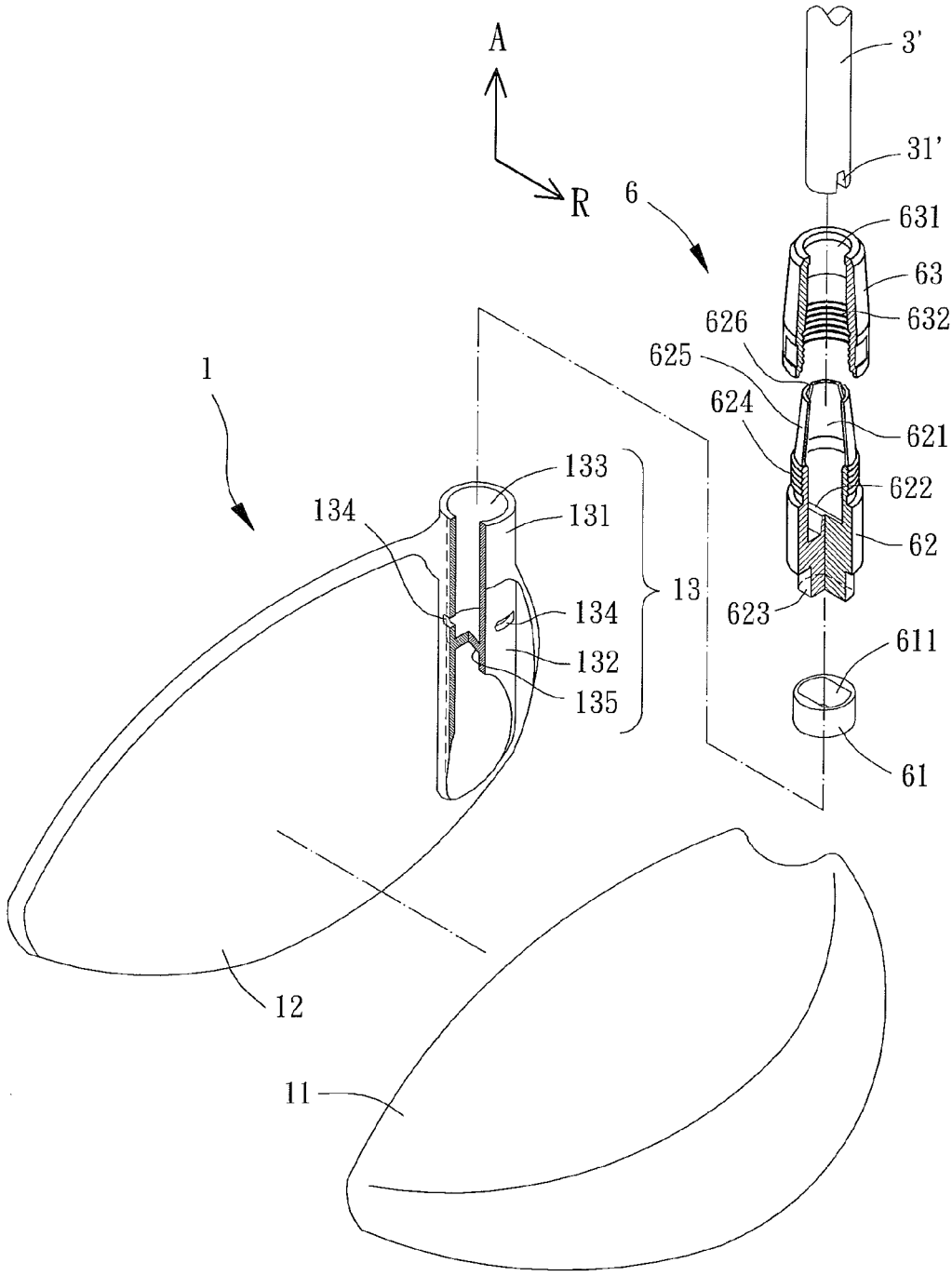
FIG. 6 is an exploded view of a golf club according to a second embodiment of the invention.
Figure 7:
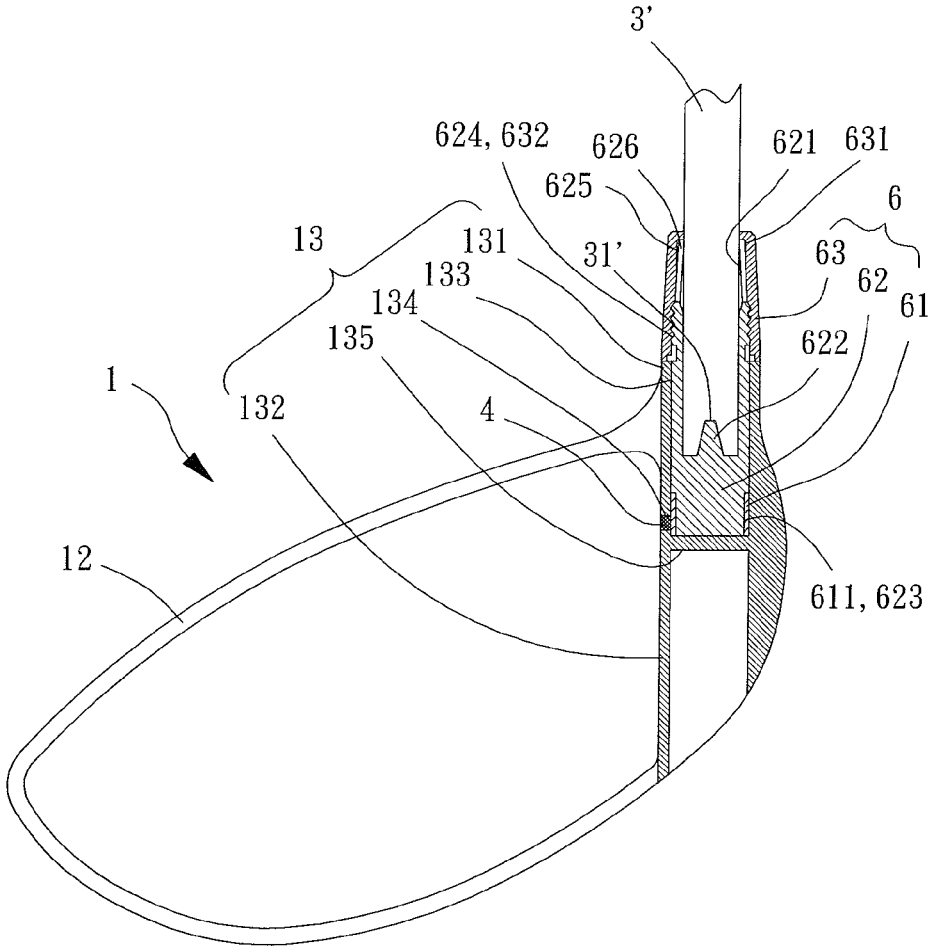
FIG. 7 is an exploded and cross sectional view of the golf club of the second embodiment of the invention.

Referring to FIGS. 6 and 7, a golf club comprising a head 1, a removable assembly 6 and a shaft 3' is disclosed according to a second embodiment of the invention. The head 1 has been described in the previous embodiment, so it is not described herein again for brevity.

The removable assembly 6 has a retaining ring 61, a case 62 and a tightening member 63. The retaining ring 61 also has an insetted hole 611 with a radial cross section in a noncircular form. The at least one engaging medium 4 may be placed in the at least one engaging hole 134 and abuts against an outer circumferential face of the retaining ring 61.

The case 62 has an insertion hole 621 and an insetting portion 623 on two ends thereof. The insertion hole 621 has a coupling portion 622 inside. The radial cross section of the insetting portion 623 is in the same shape as the insetted hole 611. The case 62 further includes a thread portion 624 and a tightening portion 625 having a gradually-reduced diameter towards the end of the case 62 where the insertion hole 621 is. The tightening portion 625 has a plurality of grooves 626 extending in the axial direction A of the tightening portion 625. The case 62 is received in the assembling hole 133, and the insetting portion 222 is inserted into the insetted hole 211. Thus, the case 62 can be prevented from rotating relatively to the sleeve 13 via the engagement between the insetting portion 623 and the insetted hole 611. An adhesive can be applied to the surface of the case 62 and the circumferential wall of the assembling hole 133 in order to securely fix the case 62 in the assembling hole 133. The tightening member 63 includes a tapered hole 631 and a thread portion 632, and the thread portion 632 is formed on a wall of the tapered hole 631.

The shaft 3' has a coupling portion 31' at one end thereof. The end of the shaft 3' having the coupling portion 31' is inserted into the tapered hole 631 of the tightening member 63 and the insertion hole 621 until the coupling portion 31' is engaged with the coupling portion 622 of the insertion hole 621. The coupling portions 31' and 622 may be a tongue and a groove respectively, but is not limited thereto. The thread portion 632 of the tightening member 63 is threadedly-engaged with the thread portion 624 of the case 62. When the tightening member 63 is screwed onto the case 62, the tapered hole 631 will squeeze the tightening portion 625 of the case 62 inwards, forcing the tightening portion 625 to closely abut against the outer circumferential surface of the shaft 3'. In this way, the shaft 3' can be securely coupled in the insertion hole 621.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A golf club comprising:

a head having a body, a striking panel and a sleeve, wherein the body is coupled with the striking panel, the sleeve is sandwiched between the body and the striking panel, the sleeve comprises a neck and an assembling portion, the neck protrudes from a combined structure of the body and the striking panel, the assembling portion is sandwiched between and enclosed by the body and the striking panel, the neck has an assembling hole extending from one end of the neck to the assembling portion, the assembling portion has at least one engaging hole extending from a surface of the assembling portion to a circumferential wall of the assembling hole, and at least one engaging medium is placed in the at least one engaging hole;

a removable assembly disposed in the assembling hole and coupled with the at least one engaging medium; and a shaft having one end inserted into the removable assembly;

wherein the removable assembly comprises a retaining ring and a case coupled with the retaining ring, the at least one engaging medium is coupled with the retaining ring, and the shaft is coupled with the case;

wherein the retaining ring has an insetted hole whose radial cross section is in a noncircular form, the case has an insertion hole and an insetting portion on two ends thereof, the shaft is partially inserted into the insertion hole of the case, the insetting portion has a radial cross section in the same shape as that of the insetted hole, and the insetting portion is inserted into the insetted hole; and wherein the circumferential wall of the assembling hole terminates in a blocking portion, and the retaining ring abuts against the blocking portion.

2. The golf club as claimed in claim 1, wherein the at least one engaging medium is coupled with an outer circumferential face of the retaining ring.

3. The golf club as claimed in claim 1, wherein a screw hole is formed on the end of the case where the insetting portion is, the blocking portion is a ring having a through-hole corresponding to the screw hole, and a fixing member is screwed into the screw hole via the through-hole.

4. The golf club as claimed in claim 1, wherein the sleeve is integrally formed on the body or the striking panel.

5. The golf club as claimed in claim 1, wherein the assembling hole extends from the one end of the neck to the assembling portion in an axial direction, with the circumferential wall defining the assembling hole extending parallel to the axial direction.

6. The golf club as claimed in claim 5, wherein the at least one engaging medium extends in a radial direction perpendicular to the axial direction from the surface of the assembling portion to the circumferential wall of the assembling hole.

7. A golf club comprising:

a head having a body, a striking panel and a sleeve, wherein the body is coupled with the striking panel, the sleeve is sandwiched between the body and the striking panel, the sleeve comprises a neck and an assembling portion, the neck protrudes from a combined structure of the body and the striking panel, the assembling portion is sandwiched between and enclosed by the body and the striking panel, the neck has an assembling hole extending from one end of the neck to the assembling portion, the assembling portion has at least one engaging hole extending from a surface of the assembling portion to a circumferential wall of the assembling hole, and at least one engaging medium is placed in the at least one engaging hole;

a removable assembly disposed in the assembling hole and coupled with the at least one engaging medium; and a shaft having one end inserted into the removable assembly;

wherein the removable assembly comprises a retaining ring and a case coupled with the retaining ring, the at least one engaging medium is coupled with the retaining ring, and the shaft is coupled with the case; wherein the retaining ring has an insetted hole whose radial cross section is in a noncircular form, the case has an insertion hole and an insetting portion on two ends thereof, the shaft is partially inserted into the insertion hole of the case, the insetting portion has a radial cross section in the same shape as that of the insetted hole, and the insetting portion is inserted into the insetted hole; and wherein the insertion hole has a coupling portion inside of a cross section smaller than the insertion hole, the shaft also has a coupling portion at the end inserted into the insertion hole, and the coupling portion of the shaft corresponds to and is coupled with the coupling portion inside the insertion hole.

8. The golf club as claimed in claim 7, wherein one of the coupling portions is a tongue and another of the coupling portions is a groove corresponding to and for slideably receiving the tongue.

9. A golf club comprising:

a head having a body, a striking panel and a sleeve, wherein the body is coupled with the striking panel, the sleeve is sandwiched between the body and the striking panel, the sleeve comprises a neck and an assembling portion, the neck protrudes from a combined structure of the body and the striking panel, the assembling portion is sandwiched between and enclosed by the body and the striking panel, the neck has an assembling hole extending from one end of the neck to the assembling portion, the assembling portion has at least one engaging hole extending from a surface of the assembling portion to a circumferential wall of the assembling hole, and at least one engaging medium is placed in the at least one engaging hole;

a removable assembly disposed in the assembling hole and coupled with the at least one engaging medium; and a shaft having one end inserted into the removable assembly;

wherein the removable assembly comprises a retaining ring and a case coupled with the retaining ring, the at least one engaging medium is coupled with the retaining ring, and the shaft is coupled with the case; wherein the retaining ring has an insetted hole whose radial cross section is in a noncircular form, the case has an insertion hole and an insetting portion on two ends thereof, the shaft is partially inserted into the insertion hole of the case, the insetting portion has a radial cross section in the same shape as that of the insetted hole, and the insetting portion is inserted into the insetted hole; and wherein the case further includes a tightening portion adjacent to the end of the case where the insertion hole is and having a gradually-reduced diameter towards the end of the case where the insertion hole is, the tightening portion has a plurality of grooves extending in an axial direction of the golf club, and the golf club further comprises a tightening member having a tapered hole squeezing the tightening portion of the case inwards, forcing the tightening portion to closely abut against an outer circumferential surface of the shaft.

* * * * *